US007044140B2

(12) United States Patent
Catini

(10) Patent No.: US 7,044,140 B2
(45) Date of Patent: May 16, 2006

(54) DEVICE FOR OBTAINING A HAIR-STYLING AND A PERMANENT

(76) Inventor: Mauro Catini, Via Tasso 15, 62012 Civitanova Marche (IT)

( * ) Notice: Subject to any disclaimer, the term of this patent is extended or adjusted under 35 U.S.C. 154(b) by 0 days.

(21) Appl. No.: 10/481,500

(22) PCT Filed: Jun. 20, 2002

(86) PCT No.: PCT/IB02/02353

§ 371 (c)(1),
(2), (4) Date: Mar. 5, 2004

(87) PCT Pub. No.: WO03/000086

PCT Pub. Date: Jan. 3, 2003

(65) Prior Publication Data

US 2004/0134508 A1 Jul. 15, 2004

(30) Foreign Application Priority Data

Jun. 21, 2001 (IT) ..... BO2001A0397

(51) Int. Cl.
*A45D 2/00* (2006.01)

(52) U.S. Cl. ..... 132/265

(58) Field of Classification Search ..... 132/223, 132/226, 236, 252, 254, 265, 261
See application file for complete search history.

(56) References Cited

U.S. PATENT DOCUMENTS

| | | | | | |
|---|---|---|---|---|---|
| 667,175 | A | * | 2/1901 | Atkinson | 24/712.5 |
| 1,385,797 | A | * | 7/1921 | Siegel | 132/261 |
| 1,591,668 | A | * | 7/1926 | Faure | 132/261 |
| 1,627,590 | A | * | 5/1927 | Baldwin | 132/261 |
| 1,917,550 | A | * | 7/1933 | Saunders | 132/226 |
| 2,142,634 | A | | 1/1939 | Edwards | |
| 2,149,134 | A | * | 2/1939 | Denis | 132/236 |
| 2,515,751 | A | | 7/1950 | Warrington et al. | |
| 2,742,046 | A | * | 4/1956 | Jurewicz | 132/267 |
| 2,767,719 | A | * | 10/1956 | Warholak | 132/252 |
| 3,081,575 | A | * | 3/1963 | Meisner | 43/43.12 |
| 5,033,487 | A | | 7/1991 | Barradas | |
| 5,042,514 | A | * | 8/1991 | Bastien | 132/270 |

* cited by examiner

*Primary Examiner*—Todd E. Manahan
(74) *Attorney, Agent, or Firm*—William J. Sapone; Coleman Sudol Sapone, P.C.

(57) ABSTRACT

An appliance for hairstyles and for applying a perm includes a flat portion (9); at least one anchorage device (8) formed on the inner surface (99) of the flat portion (9) for deflecting and anchoring a strand of hair. At least one fastening member (7) is formed on the inner surface (99) of the flat portion (9) for fixing the strand of hair.

20 Claims, 4 Drawing Sheets

DEVICE FOR OBTAINING A HAIR-STYLING AND A PERMANENT

TECHNICAL FIELD OF THE INVENTION

The present invention relates to appliances used for hairstyles and for applying a perm.

DESCRIPTION OF PRIOR ART

The so-called "flat-wave" hairstyle is obtained by means of an appliance called "hot-iron" by those who work in the field, on which a lock of hair is rolled to obtain a desired waving due to the heat radiated by the iron heated in a known way.

In other cases, permanent waves desired by the client are obtained by curling rollers having different shape, used by the operators together with special acids for fixing the hairstyle.

The curling rollers each includes a small elastic strip, stretched longitudinally with respect to the roller, and aimed at keeping the roller fixed to the hair lock during use.

The known technique for making a hairstyle and for applying a perm with a predetermined wave has, however, some drawbacks.

The appliance used for a "flat-wave" hairstyle requires skilled personnel, since a remarkable ability, gained during years of a hairdresser work, is necessary to wind correctly a lock of hair on the iron.

This drawback raises considerably the cost for personnel; in fact, if the iron is used by an inexperienced operator, the time needed to wind correctly a lock of hair on the iron increases considerably, and consequently, the time needed for the whole hairstyle increases too.

In case of perm application, where acids for fixing the hairstyle are used, the shape of the curlers and the pressure of the elastic strip on the lock hair to be fastened cause damages (incision or cuts of the hair) of the portion of the lock of hair under the elastic strip.

SUMMARY OF THE INVENTION

The object of the present invention is to propose an appliance for hairstyles and for applying a perm, which helps the operator to obtain desired results, thus speeding up the job.

Another object of the present invention is to propose an appliance, which allows to obtain a large number of hairstyles, invented by the operator performing the hairstyle or applying the perm.

A further object of the present invention is to propose an appliance which can be used also by not very experienced operators.

A still further object of the present invention is to propose an appliance whose concept is simple and whose cost is low.

The above mentioned objects are obtained, according to the invention, by the present appliance for hairstyles and for applying a perm, characterized in that it includes: a flat portion 9; at least one anchorage means 8, formed on the inner surface 99 of said flat portion 9, defining means for deflecting and anchoring a strand of hair; at least one fastening member 7, formed on the inner surface 99 of the flat portion 9 defining means for fixing the strand of hair.

BRIEF DESCRIPTION OF THE DRAWINGS

The characteristic features of the invention are pointed out with reference to the enclosed drawings, in which.

DESCRIPTION OF THE PREFERRED EMBODIMENTS

Figure 1:
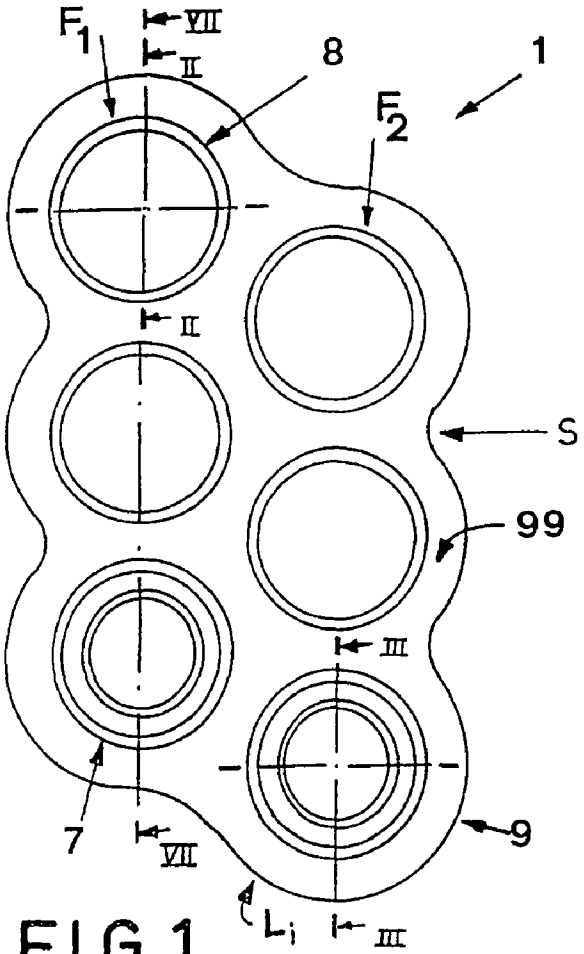
FIG. 1 is a front view of an appliance for hairstyles and perms.

With reference to the accompanying drawings, reference numeral 1 indicates an appliance for hairstyles and perms, which, as shown in FIG. 1, includes: a flat portion 9; a plurality of anchorage means 8, formed on the inner surface 99 of the flat portion 9; fastening means 7, also formed on the inner surface of the flat portion 9.

The appliance for hairstyles and perms 1 is made of a heat conducting material resistant to the acids for fixing the hairstyle and can be used for hairstyles as well as perms.

Otherwise, the flat portion 9 can be in form of a reticular structure (not shown) made from the above mentioned material, the function of which will be explained later, and/or having a series of first fixing means 4, e.g. pointed projections, whose function will be explained later.

In the specific case shown in FIG. 1, the anchorage means 8 and the fastening means 7 are arranged in two rows F1, F2; each of the anchorage means 8 of one row is offset with respect to the adjacent anchorage means of the other row, and each of the fastening means 7 is associated to one row and situated near the lower longitudinal portion Li of the flat portion 99; the function of such arrangement will be explained later.

Figure 2:
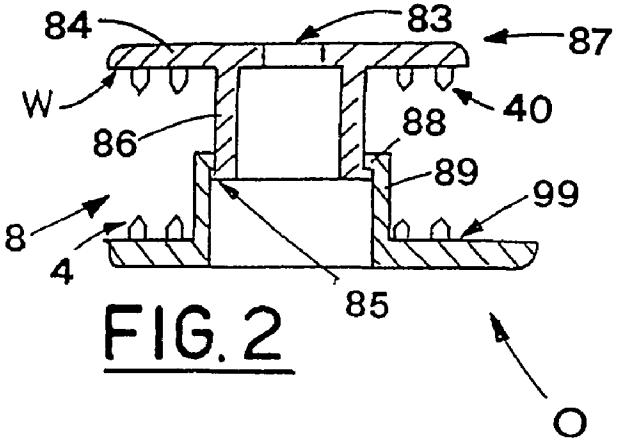
FIG. 2 is a section view taken along II—II of FIG. 1, with the sectioned member in opened position.

Each of the anchorage means 8, as shown in FIG. 2, is formed of two parts: a body 89, fixed to or made integral with the inner surface 99, with e.g. circular or elliptic shape, bored axially and having at top a ring-like shoulder 88 extending inwards towards the inner part of the body 89; a plug-like element 87 is coupled with the body 89.

The plug-like element 87 includes a shank 86, e.g. circular or elliptic, introduced into the body 89 and having, in its lower part, a collar 85, and a plate 84, e.g. circular or elliptic, formed at the top of the shaft 86, and in the specific case having a hole 83 made in its central part.

The lower surface W of the plate 84 includes a series of second fixing means 40, e.g. pointed projections, coaxial with the first fixing means.

The plug-like element 87 moves vertically between two extreme positions: a first one, in which the extension is minimum, or closed position, not seen, in which the plug-like element 87 is pushed downwards, so that the lower surface of the plate 84 goes in abutment against the upper end of the body 89; a second maximum extension position O, or open position, FIG. 2, in which the plug-like element 87 is raised and the collar 85 of the shank 87 goes in abutment against the shoulder 88 of the body 89, so as to prevent it from getting out; and an intermediate or stabilization position, in which the plug-like element 87 is partially received by the inner part of the body 89, not seen in the enclosed drawings.

Figure 3:
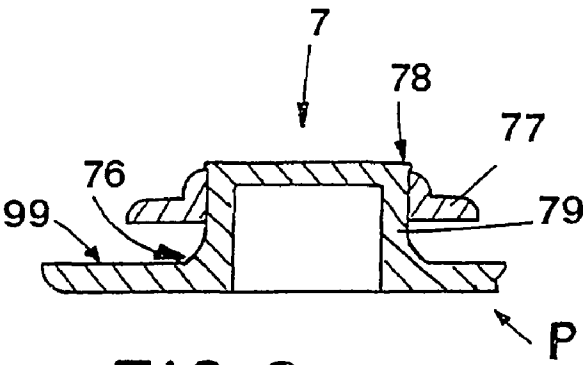
FIG. 3 is a section view taken along III—III of FIG. 1, with the sectioned member in non-operating position.

Each of the fastening means 7 includes: a body 79, fixed to or made integral with the inner surface 99, having at top an enlargement 78, and at bottom, a thickening 76; a disc 77, fitted on the body 79, moving vertically between two positions, one of which is an active position, not seen in the enclosed drawings, in which the lower surface of the disc 77 goes in abutment against the thickening 76 of the body 79, so as to come near the inner surface 99 of the flat portion 9, and the other one is a rest position P, FIG. 3, of maximum raising, in which the upper part of the disc 77 goes in abutment against the thickening 78.

Figure 4A:
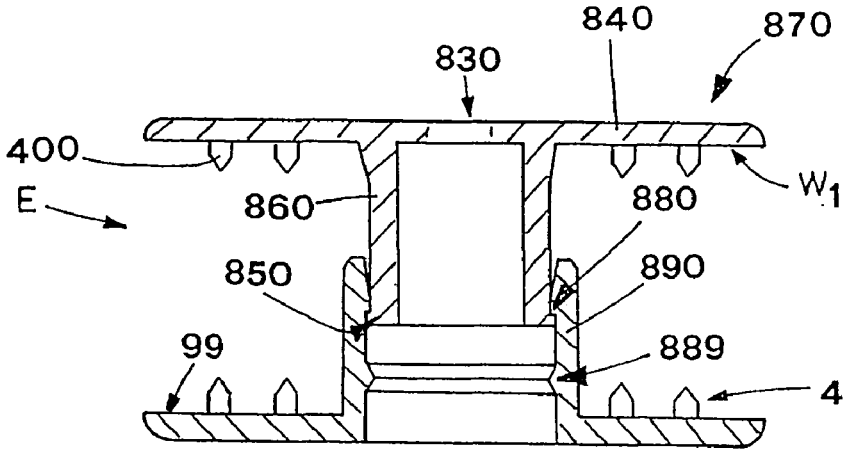
FIG. 4*a* is a view of another embodiment of what has been shown in FIG. 2, pointing out the open position of the shown member.
Figure 4B:
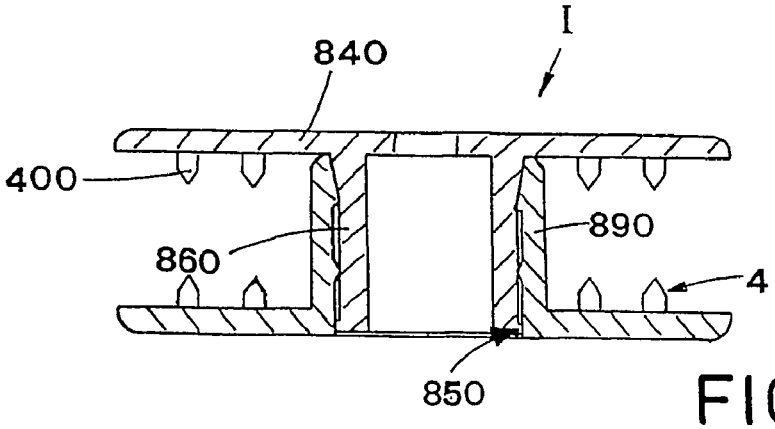
FIG. 4*b* is the same view as FIG. 4*a*, with the member in closed position.

As seen in FIGS. 4*a*, 4*b*, the anchorage means 8, according to a second embodiment, includes two parts: a body 890, fixed to or made integral with the inner surface 99, e.g. with a circular or elliptic profile, bored axially and featuring, inside its upper end, a ring-like shoulder 880, and inside the central part of the body 890, a ring-like projection 889; a plug-like element 870 is coupled with the body 890.

The plug-like element 870 includes a shank 860, with e.g. circular or elliptic shape, introduced into the body 890 and having, in its lower part, a collar 850, and a plate 840, with e.g. circular or elliptic shape, formed at the upper end of the shaft 860, and in the specific case having a hole 830 made in its central part.

The lower surface W1 of the plate 840 includes a series of second fixing means 400, e.g. pointed projections, coaxial with the first fixing means 4.

The plug-like element 870 moves vertically between two extreme positions: a minimum extension position I, or closed position, shown in FIG. 4*b*, in which the plug-like element 870 is pushed downwards, so that the lower surface of the plate 840 goes in abutment against the upper end of the body 890; a maximum extension position E, or open position, shown in FIG. 4*a*, in which the plug-like element 870 is raised and the collar 850 of the shank 860 goes in abutment against the shoulder 880 of the body 890, so as to prevent it from getting out; and an intermediate or stabilization position, not seen in the drawings, in which the lower end of the collar 850 goes in abutment against the ring-like projection 889.

Figure 5A:
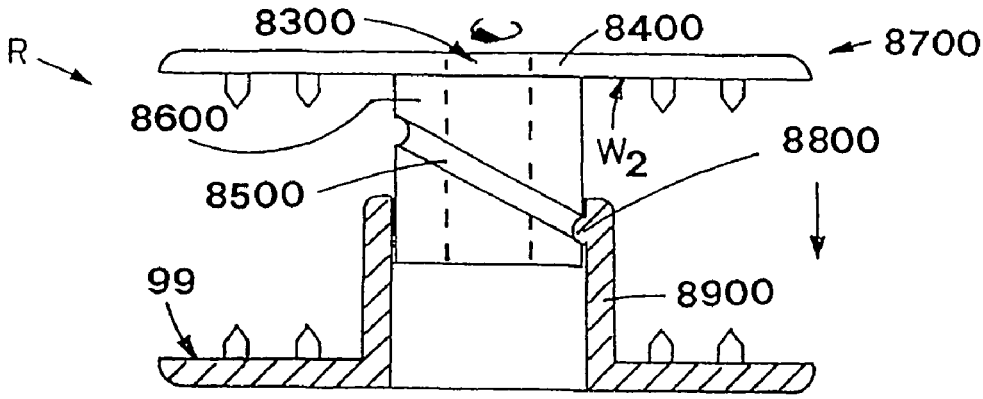
FIG. 5*a* shows a third embodiment of what has been shown in FIG. 2, pointing out the open position of the shown member.
Figure 5B:
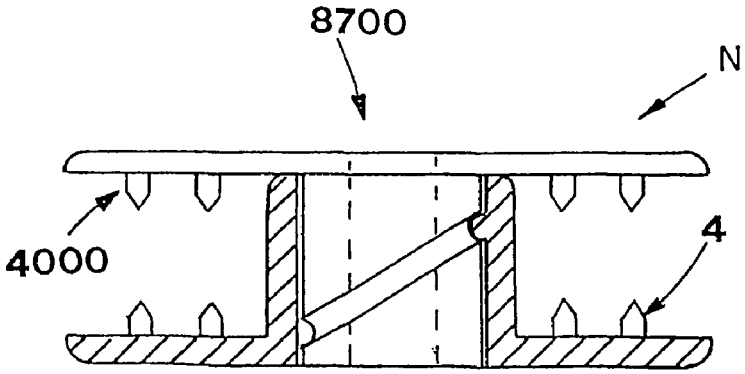
FIG. 5*b* is the same view as FIG. 5*a*, with the shown member in closed position.

As it is seen in FIGS. 5*a*, 5*b*, the anchorage means 8 according to a third embodiment includes two parts: a body 8900, fixed to or made integral with the inner surface 99, bored axially and having, at its upper end, a helical protrusion 8800, made on the inner part of the body 8900; a plug-like element 8700 is coupled with the body 8900.

The plug-like element 8700 includes a shank 8600, introduced into the body 8900 and having, in its outer part, a helical groove 8500 which engages with the projection 8800 of the body 8900; and a plate 8400, formed at the upper end of the shaft 8600, and having a hole 8300 made in its central part.

The lower surface W2 of the plate 8400 includes a series of second fixing means 4000, e.g. pointed projections, coaxial with the first fixing means 4.

The plug-like element 8700 moves vertically between two extreme positions: a minimum extension position N or closed position, shown in FIG. 5*b*, in which the plug-like element 8700 is pushed downwards due to the rotation of he plug-like element 8700 on its axis, so that the lower surface of the plate 8400 goes in abutment against the upper end of the body 8900; a maximum extension position R, or open position, shown in FIG. 5*a*, in which the plug-like element 8700 is raised and the groove 8500 made on the shank 8600 is engaged with the projection 8800 of the body 8900, so as to prevent the latter from going out; and an intermediate or stabilization position, not seen in the drawings, in which the plug-like element 8700 is partially raised.

Figure 6A:
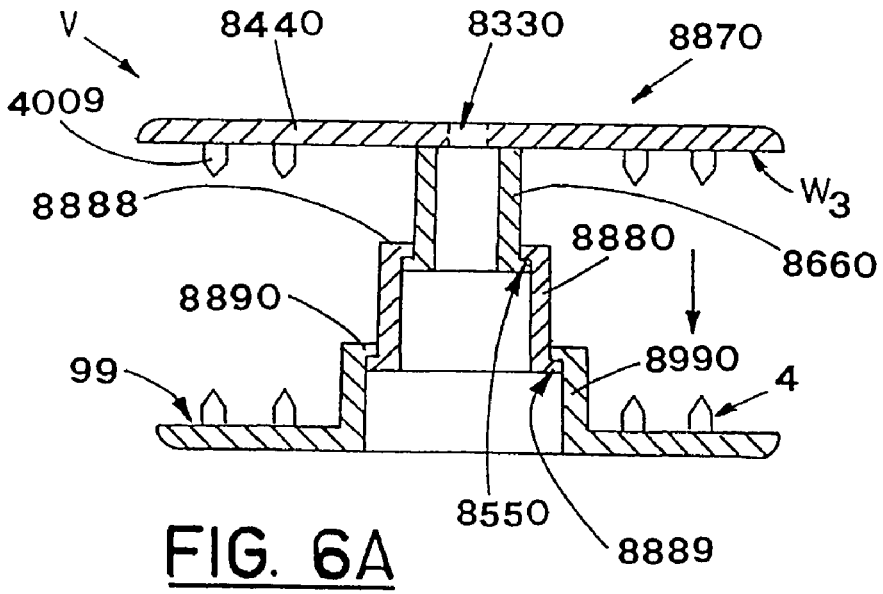
FIG. 6*a* shows a fourth embodiment of what has been shown in FIG. 2, pointing out the open position of the shown member.
Figure 6B:
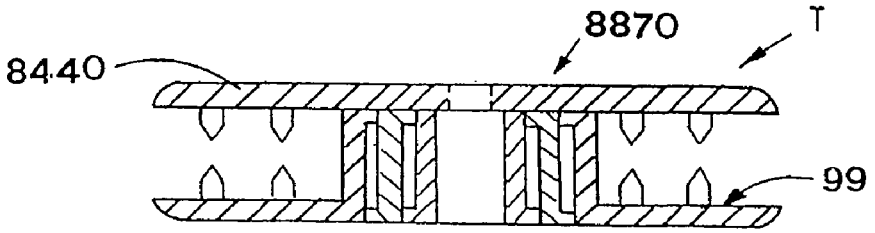
FIG. 6*b* is the same view as FIG. 6*a*, with the shown member in closed position.

As seen in FIGS. 6*a*, 6*b*, the anchorage means 8, according to a fourth embodiment includes two parts: a body 8990, fixed to or made integral with the inner surface 99, with e.g. circular or elliptic shape, bored axially and having, at its upper end, a ring-like shoulder 8890 extending inward towards the inner part of the body 8990; an intermediate element 8880, introduced into the body 8990, bored axially and featuring, outside of its lower end, a first bead 8889, and inside the upper end of the intermediate element 8880, a second bead 8888; a plug-like element 8870 is coupled with the body 8990.

The plug-like element 8870 is formed by two parts: a shank 8660, having e.g. circular or elliptic shape, featuring, in its lower portion a third bead 8550, with the shaft 8660 introduced into the body 8990 and a plate 8440, with e.g. circular or elliptic shape, formed at the upper end of the shaft 8660, and in the specific case having a hole 8330 made in its central part.

The lower surface W3 of the plate 8440 includes a series of second fixing means 4009, e.g. pointed projections, coaxial with the first fixing means 4.

The plug-like element 8870 moves vertically between two extreme positions: a minimum extension position T or closed position, shown in FIG. 6*b*, in which the plug-like element 8870 is pushed downwards, so that the intermediate element 8880 is received by the inner part of the body 8990, the shank 8660 is received by the inner part of the intermediate element 8880, and the lower surface of the plate 8440 goes in abutment against the upper end of the body 8990 as well as against the upper end of the intermediate element 8880; a maximum extension position V, or open position, shown in FIG. 6*a*; in which the intermediate element 8880 is raised to abut with the first bead 8889 against the shoulder 8890 of the body 8990, the plug-like element 8870 is raised, with the third bead 8550 going in abutment against the second bead 8888 of the intermediate element 8880, so as to prevent it from getting out; and an intermediate or stabilization position, not seen in the drawings, in which the intermediate element 8880 is received by the inner part of the body 8990, while the plug-like element 8870 is raised, so that the third bead 8550 of the plug-like element 8870 goes in abutment against the second bead 8888 of the intermediate element 8880.

As pointed out in FIG. 1, the appliance 1 features, along its whole edge, a series of narrowing sections S, whose number depends on the number and arrangement of the anchorage means 8 and fastening means 7.

The appliance for hairstyles and perms according to a second embodiment can be formed by only one anchorage member 8, where the dimension of the flat portion is substantially equal to the dimension of the plate 84, 840,

8400, and the anchorage member 8 is an element for anchoring and stabilizing a strand of hair.

Therefore, the single anchorage member constitutes the appliance for hairstyles and perms, in which the anchorage member can be obtained according to all the previously described embodiments, shown in FIGS. 2, 4*a*, 4*b*, 5*a*, 5*b*, 6*a*, 6*b*.

According to another embodiment, not shown, the appliance 1 can be defined by a flat portion featuring at least two anchorage members obtained as described before, where one of the members has the circular body and the plate and the other member has the elliptic body and the plate.

The use of the appliance 1, or of the appliance with a single anchorage member, requires setting the appliance to the maximum extension position O, E, R, V; then the operator separates a strand of hair and, on the basis to the undulation desired by the client, decides to follow a path around the anchorage members 8 and to fasten the tips of the hair to one or more fastening means 7.

It is to be pointed out that this appliance is proposed to perform hairstyles and to apply perms on hair of different length.

If the client wants a hairstyle with short hair, the operator will use all the anchorage members present on the flat portion 99 of the appliance 1.

If the client wants a hairstyle with long hair, the operator will not use all the anchorage members present on the flat portion 99, but will use alternate anchorage members.

Otherwise, if the client wants a voluminous hairstyle, the operator will use all the anchorage members present on the flat portion 99 of the appliance 1 and will anchor (wind) the strand of hair to each of the anchorage members.

If the appliance with only one anchorage member is used, the operator will wind the strand of hair around the anchorage member, once or more times, according to the desired undulation.

In order to perform a hairstyle or apply a perm, the plug-like element 87, 870, 8700, 8870, is set to the open position O, E, R, V, the strand of hair is wound following a predetermined path, the plug-like element 87, 870, 8700, 8870 is lowered to the intermediate position, with help of the first and second fixing means, respectively 4, 40, 400, 4000, 4009, to define a pre-fastening of the strand of hair, and if there are fastening means 7, the end of the strand of hair is placed under the disc 77, which is then set to the active position to fasten the end of the strand of hair.

In order to perform a desired hairstyle, the appliance is heated (by apparatuses known to those expert in the field), so that the heat propagates over the flat portion 99 and over the plate 84, 840, 8400,8440 of the plug-like element 87, 870, 8700, 8870 to fix the hair wave.

In order to apply a perm, after having positioned the strand of hair as described above, the acids for fixing the hairstyle are applied to the strand of hair and left for a predetermined period of time; afterwards, the strand of hair suitably fastened to the appliance is rinsed to remove the used fixing acids.

The described appliance for hairstyles and perms is particularly advantageous because its conformation allows a wide use for obtaining hairstyles and/or perms with more or less undulated waves.

The presence of a flat portion 9 equipped with anchorage and fastening means, or equipped with a single anchorage member, makes the appliance very functional and usable also by not experienced operators.

Actually, it is necessary to follow a predetermined path around the anchorage means, or wind the strand of hair once or more times around the anchorage member, in order to obtain the desired undulation for hairstyle as well as for perms.

The proposed appliance leaves space for the operator's fantasy, since he can create particular undulations by changing the path of each strand of hair around the anchorage member or members.

The anchorage members 8 formed by two parts, i.e. a body 89, 890, 8900, 8990 and a plug-like element 87, 870, 8700, 8870, which moves vertically inside the body, allow to position the strand of hair in a simple way, because the plug-like element 87, 870, 8700, 8870 in its maximum extension position O, E, R, V allows the operator to deviate or wind the strand of hair around the body 89, 890, 8900, 8990 and around the shank 86, 860, 8600, 8660, and, according to the embodiment shown in FIG. 6*a*, around the intermediate element 8880 of the anchorage member 8.

Moreover, the operator can lock the position of the strand of hair by pushing the 84, 840, 8440 plate 84, 840, 8440 or by rotating the plug-like element 8700 on its axis, so as to place the plug-like element 87, 870, 8700, 8870 in its intermediate position, and consequently to stabilize the strand of hair under the plate 84, 840, 8440 of the corresponding plug-like element.

The first and second fixing means 4, 40, 400, 4009 made on the inner surface 99 and on the lower surface W, W1, W2, W3 of the plate 84, 840, 8440 allow, due to the arrangement of the anchorage member 8 in the working position, to stabilize the strand of hair, because the first and second fixing means clamp the strand of hair wound around the anchorage member 8.

The fastening means 7, shaped and arranged as described before, allow the operator, due to the arrangement of the fastening means 7 in non active position P, to wind the tips of hair around the body 79 and to block the strand of hair by arranging the disc 77 in the active position: thus undesired waves are avoided at the tips of the hair.

Figure 7:
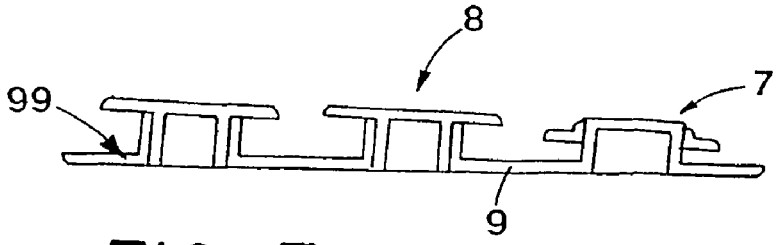
FIG. 7 is a section view taken along VII—VII of FIG. 1.

As seen in FIG. 7, the anchorage members 8 and the fastening means 7 can be inclined with respect to the fastening surface, i.e. flat portion 9, and are at a different level in a decreasing way, downwards.

The arrangement of the anchorage members 8 and the fastening means 7 is determined by the fact that the strand of hair is thicker near the hair roots and thinner near the tips, which derives from the fact that each strand is composed of hair of different age: the shortest are the youngest, while the longest are the oldest.

The inclination of the anchorage members 8 and the fastening means 7 and their height depend on the thickness of the strand of hair, and depend also on the fact that the appliance 1 must be used for hairstyles and for perms, therefore in case of perms, the heat and its propagation must be uniform on the whole extension of the appliance; otherwise the waves are not homogenous along the whole length of the strand and the hairstyle does not last for long time.

The reticular structure of the appliance is advantageous.

If the appliance 1 is used for applying a perm, the best final result is obtained thorough rinsing the strand of hair anchored to the appliance after the use of the appliance and application of the fixing acids, if the fixing acids are not removed completely from the strand of hair, a "frizzy" effect is obtained, which is not natural.

The fact that the device is made from a reticular structure allows a correct rinsing of the hair strands, because water pass through the network structure, thus permitting a complete removal of the fixing acids which have been used.

Also the presence of the holes 83, 830, 8300, 8330 on the plate 84, 840, 8400, 8440 makes it easier for the water to pass through the device described herein.

Moreover, the device is particularly useful because by its use, any undesired waves, either provoked by a non correct winding of the hair strand on a conventional hair roller, or due to the pressure of the fixing elastic strip (described in the introductory statement) used to fix the roller, are prevented.

Furthermore, the hair strand situated below the elastic strip is not damaged.

The narrowing sections S made in the outer profile of the device 1 render the device shapely. They also are aimed at receiving the fingers of the operator while applying the device making it easier to handle.

It is understood that the above has been described as an unlimited example only, and therefore possible practical or applicative variations are intended as included within the protection scope as described above and claimed in the following.

The invention claimed is:

1. An appliance for hairstyles and for applying a perm comprising:

a flat portion (9);

at least one anchorage means (8), formed on the inner surface (99) of said flat portion (9) for defining means for anchoring and fixing a strand of hair, the anchoring means (8) including a body (89), fixed to or made integral with the inner surface (99), bored axially and having at top a ring-like shoulder (88) extending inwards towards the inner part of the body (89);

a plug-like element (87), coupled with the body (89) and including a movable shank (86) introduced into the body (89) and having a collar (85) at bottom, and a plate (84) at a top thereof facing the flat plate (9), the plate (84) movable into proximity with the flat plate (9) for fixing hair strands therebetween;

fastening means (7) including a body (79), fixed to or made integral with an inner surface (99), having at top an enlargement (78), and at bottom, a thickening (76);

a disc (77), fitted on the body (79) and movable vertically between two positions, one of which is an active position, in which the lower surface of the disc (77) goes in abutment against the thickening (76) of the body (79), so as to come near the inner surface (99) of the flat portion (9), and another one which is a maximum raising inactive position'(P), in which the upper part of the disc (77) goes in abutment against the enlargement (78), said anchoring means (8) and said fastening means (7) are arranged in two rows (F1, F2) and each anchoring means (8) of a row is offset with respect to the adjacent anchoring means of the other row, and each fastening means (7) is associated to one row and is situated near the lower longitudinal portion (Li) of the flat portion (99).

2. The appliance according to claim 1 wherein said ring like shoulder has in its central part a ring-like protrusion (889) extending inwards.

3. The appliance according to claim 2 wherein said plug-like element (870) is movable vertically between two extreme positions: a minimum extension or closed position (I), in which the plug-like element (870) is pushed downwards, so that a lower surface of the plate (840) is in abutment against: an upper end of the body (890); a maximum extension or open position (E), in which the plug-like element (870) is raised and the collar (850) of the shank (860) is in abutment against the shoulder (880) of the body (890), so as to prevent removal; and an intermediate or stabilization position, in which the lower end of the collar (850) goes in abutment against the ring-like projection (889).

4. The appliance according to claim 1 further comprising: an intermediate element (8880), introduced into the body which has, outside of its lower end, a first bead (8889), and inside an upper end of the intermediate element (8880), a second bead (8888);

the plug-like element (8870) having, in its outer part, a third bead (8550).

5. The appliance according to claim 4 wherein said plug-like element (8870) is movable vertically between two extreme positions: a minimum extension or closed position (T), in which the plug-like element (8870) is pushed downwards, so that the intermediate element (8880) is received inside the body (8990), the shank (8660) of said plug-like element (8870) being received inside the intermediate element (8880), and the lower surface of the plate (8440) or the said plug-like element goes in abutment against an upper end of the body (8990) as well as against an upper end of the intermediate element (8880); a maximum extension or open position (V), in which the intermediate element (8880) is raised to make the first bead (8889) connected to the intermediate element abut against the shoulder (8890) of the body (8990), the plug-like element (8870) being raised with the third bead (8550) going in abutment against the second bead (8888) of the intermediate element (8880), so as to prevent removal; and an intermediate or stabilization position, in which the intermediate element (8880) is received inside the body (8990), while the plug-like element (8870) is raised, so that the third bead (8550) of the plug-like element (8870) goes in abutment against the second bead (8888) of the intermediate element (8880).

6. The appliance according to claim 1 wherein said plug-like element (87) is movable vertically between two extreme positions: a first minimum extension or closed position, in which the plug-like element (87) is pushed downwards, so that a lower surface of the plate (84) is in abutment against an upper end of the body (89); a second maximum extension or open position, in which the plug-like element (87) is raised and the collar (85) of the shank (87) is in abutment against the shoulder (88) of the body (89), so as to prevent removal; and an intermediate or stabilization position, in which the plug-like element (87) is partially received by the inner part of the body (89).

7. The appliance according to claim 1 wherein a lower surface of said plate (84) has second fixing means (40), which in the closed position of said anchoring means (8), hold the hair strand wound on the anchoring means (8).

8. The appliance according to claim 1 wherein a lower surface of said plate (84) has second fixing means (40), which in the closed position of said anchoring means (8), hold the hair strand wound on the anchoring means (8).

9. The appliance according to claim 1 wherein an, inner surface (99) of said flat portion (9) has first fixing means (4) and a lower surface (W) of said plate (84) has second fixing means (40), which cooperate with each other in the closed position of said anchoring means (8) to firmly bold the hair strand wound on the anchoring means (8).

10. The appliance according to claim 1 wherein said body (89) and said shank (86) have circular profiles.

11. The appliance according to claim 1 wherein said plate (84) has a circular profile.

12. The appliance according to claim 1 wherein said plate (84) has a hole (83) in its central part.

13. The appliance according to claim 1 wherein said flat portion (9) is made of a heat-conductive material for fixing a waving of the hair strand by heating.

14. The appliance according to claim 1 wherein said flat portion (9) is made from a reticular structure of a heat-conductive material for fixing a waving of the hair strand by heating.

15. An appliance for hairstyles and for applying a perm comprising:

a flat portion (9):

at least one anchorage means (8), formed on the inner surface (99) said flat portion (9) for defining means for anchoring and fixing a strand of hair, the anchorage means (8) including a body (89), fixed to or made integral with the inner surface (99), bored axially and having at top a helical protrusion (8800), made on the inner part of the body (8900)

a plug-like element (8700), coupled with the body (8900) and including a shank (8600) introduced into the body (8900) and having, in its outer part, a helical groove (8500) which engages with the projection (8800) of the body (8900), and a plate (8400) at top facing the flat plate (9), the plate (84) movable into proximity with the flat plate (9) for fixing hair strands therebetween;

fastening means (7) including a body (79), fixed to or made integral with an inner surface (99), having at top an enlargement (78), and at bottom, a thickening (76); a disc (77), fitted on the body (79) and movable vertically between two positions, one of which is an active position, in which the lower surface of the disc (77) goes in abutment against the thickening (76) of the body (79), so as to come near the inner surface (99) of the flat portion (9), and another one which is a maximum raising inactive position'(P), in which the upper part of the disc (77) goes in abutment against the enlargement (78), said anchoring means (8) and said fastening means (7) are arranged in two rows (F1, F2) and each anchoring means (8) of a row is offset with respect to the adjacent anchoring means of the other row, and each fastening means (7) is associated to one row and is situated near the lower longitudinal portion (Li) of the flat portion (99).

16. The appliance according to claim 15 wherein said plug-like element (8700) is movable vertically between two extreme positions: a minimum extension or closed position (N), in which the plug-like element (8700) is pushed downwards due to rotation of the plug-like element (8700) on its axis, so that a lower surface of the plate (8400) is in abutment against the upper end of the body (8900); a maximum extension or open position (R), in which the plug-like element (8700) is raised and the groove (8500) made on the shank (8600) is engaged with the projection (8800) of the body (8900), so as to prevent removal; and an intermediate or stabilization position, in which the plug-like element (8700) is partially raised.

17. An appliance for hairstyles and for applying a perm comprising:

a flat portion (9);

at least one anchorage means (8), formed on the inner surface (99) of said flat portion (9) for defining means for anchoring and fixing a strand of hair, the anchoring means (8) including a body (89), fixed to or made integral with the inner surface (99), bored axially and having at top a ring-like shoulder (88) extending inwards towards the inner part of the body (89);

a plug-like clement (87), coupled with the body (89) and including a movable shank (86) introduced into the body (89) and having a collar (85) at bottom, and a plate (84) at a top thereof facing the flat portion (9), the plate (84) movable into proximity with the flat portion (9) for fixing hair strands therebetween;

fastening means (7) including a body (79), fixed to or made integral with an inner surface (99), having at top an enlargement (78), and at bottom, a thickening (76);

a disc (77), fitted on the body (79) and movable vertically between two positions, one of which is an active position, in which the lower surface of the disc (77) goes in abutment against the thickening (76) of the body (79), so as to come near the inner surface (99) of the flat portion (9), and another one which is a maximum raising inactive position'(P), in which the upper part of the disc (77) goes in abutment against the enlargement (78), said anchoring means (8) and fastening means (7) being inclined with respect to said flat portion (9), said anchoring means (8) and fastening means (7) having different heights with decreasing order from a top downwards.

18. The appliance according to claim 17 wherein an inner surface (99) of said flat portion (9) has first fixing means (4), which in the closed position of said anchoring means (8), hold the hair strand wound on the anchoring means (8).

19. The appliance according to claim 17 wherein a lower surface of said plate (84) has second fixing means (40), which in the closed position of said anchoring means (8), hold the hair strand wound on the anchoring means (8).

20. The appliance according to claim 17 wherein an inner surface (99) of said flat portion (9) has first fixing means (4) and a lower surface (W) of said plate (84) has second fixing means (40), which cooperate with each other in the closed position of said anchoring means (8) to firmly hold the hair strand wound on the anchoring means (8).

* * * * *